US009070349B1

(12) United States Patent
Fischer

(10) Patent No.: US 9,070,349 B1
(45) Date of Patent: Jun. 30, 2015

(54) MUSICAL INSTRUMENT STRAP

(71) Applicant: James Warren Fischer, Oakland, CA (US)

(72) Inventor: James Warren Fischer, Oakland, CA (US)

( * ) Notice: Subject to any disclaimer, the term of this patent is extended or adjusted under 35 U.S.C. 154(b) by 170 days.

(21) Appl. No.: 13/986,584

(22) Filed: May 15, 2013

(51) Int. Cl.
*G10D 3/00* (2006.01)
*G10G 5/00* (2006.01)

(52) U.S. Cl.
CPC ..... *G10G 5/005* (2013.01)

(58) Field of Classification Search
CPC ..... G10G 5/005; G10D 3/00
USPC ..... 84/327
See application file for complete search history.

(56) References Cited

U.S. PATENT DOCUMENTS

2006/0054002 A1* 3/2006 Tambara ..... 84/327
2011/0203441 A1* 8/2011 Naylor ..... 84/327
2011/0204758 A1* 8/2011 Loncar et al. ..... 312/223.1

* cited by examiner

*Primary Examiner* — Jianchun Qin
(74) *Attorney, Agent, or Firm* — Risto A. Rinne, Jr.

(57) ABSTRACT

An apparatus for holding a musical instrument has a strap that is secured at a first end to a base of the instrument by magnetism. An opposite second end is secured around a neck of the instrument by any of various ways. If available, an overall length of the strap is adjusted. The first end of the strap is secured to the base of the instrument by the use of one or more magnets disposed on one side of a planar rear surface of the base and by a ferric or steel member disposed on an opposite side of the rear surface. Magnetic attraction pinches and secures the magnets and steel member in position until urged apart. Fabric covering around the magnets and steel member prevent damage. The magnets or, alternately, the steel member are inserted through a sound hole into an interior of the instrument base.

18 Claims, 6 Drawing Sheets

MUSICAL INSTRUMENT STRAP

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

The present invention, in general, relates to straps for holding a musical instrument and, more particularly, to a strap that is secured to an instrument that includes a sound hole, such as a guitar or ukulele.

The sound hole is an opening provided on a front surface of a stringed instrument that helps project the sound created by vibrations of the strings while the instrument is being played.

Straps for ukuleles, in particular, are not generally available. Ukuleles originated in Hawaii and are most commonly associated with Hawaiian culture. The distinctive sound created by the ukulele often accompanies images of sandy beaches and women in grass skirts dancing the hula. Although popular in Hawaii, people enjoy playing the ukulele all over the world.

Ukuleles are small string instruments similar to a guitar. However, unlike a guitar which includes six strings, ukuleles only have four. The strings are typically made from nylon which helps attribute to the unique sound produced when strumming the ukulele's nylon strings.

Ukuleles are available in four sizes, each one producing its own sound and tone. The standard ukulele is called a "Soprano" and is about 21-inches in total length from a bottom of the ukulele body to the top of the headstock portion. The largest ukulele is called a "Baritone" and is 30-inches in total length. Intermediate sizes are the "Concert" at 23-inches and the "Tenor" at 26-inches. Compared to a standard acoustic guitar, the ukulele is much smaller.

The small size allows ukuleles to be easily played and transported. Beach goers and campers can take along a ukulele to enjoy playing next to the water or campfire. The atmosphere can be easily transformed into a tropical mood by simply strumming a few chords.

While playing the ukulele, a person holds the ukulele against their body, typically in front of their chest. An arm is folded across the body of the ukulele while the ukulele is played. The playing arm helps hold the ukulele in in position. The other hand holds the ukulele at various positions along a fret board.

Ukuleles are not typically designed with strap buttons that are used to attach a strap, as found on a guitar. A strap helps hold the weight of the instrument while it is being played and also provides a hands-free holding of the instrument when not in use. Guitar strap buttons are steel flanged posts that are generally installed (i.e., screwed) onto the guitar during manufacture. The strap button is located on a bottom of the guitar body and at top of the neck of the guitar.

If desired, the ukulele can be modified to include the strap buttons. However, as the strap buttons must be screwed into the body of the ukulele, damage to the body or scratches to the finish of the ukulele may occur.

Prior art ukulele straps include a neck strap that is fashioned like a necklace and worn around a neck of the person playing the ukulele. The neck strap includes a large looped strap that is placed around the neck. The neck strap includes a clip at a lower end of the loop that is affixed onto a sound hole of the ukulele. The clip loosely hooks onto the sound hole and is in direct contact with the wood (or plastic) comprising the body of the ukulele. Movement of the clip may cause damage to the finish of the ukulele. A scratched ukulele is less aesthetically pleasing to look at and may diminish the value of the instrument.

Furthermore, the neck strap only holds the ukulele in one location (i.e., at the sound hole) thereby exerting stress on the neck as the weight of the ukulele is not evenly distributed along the strap. The clip is prone to slippage, as well. This can allow the ukulele to fall causing considerable damage.

Accordingly, there exists today a need for a musical instrument strap that helps to ameliorate the above-mentioned problems and difficulties as well as ameliorate those additional problems and difficulties as may be recited in the "OBJECTS AND SUMMARY OF THE INVENTION" or discussed elsewhere in the specification or which may otherwise exist or occur and that are not specifically mentioned herein.

As various embodiments of the instant invention help provide a more elegant solution to the various problems and difficulties as mentioned herein, or which may otherwise exist or occur and are not specifically mentioned herein, and by a showing that a similar benefit is not available by mere reliance upon the teachings of relevant prior art, the instant invention attests to its novelty. Therefore, by helping to provide a more elegant solution to various needs, some of which may be long-standing in nature, the instant invention further attests that the elements thereof, in combination as claimed, cannot be obvious in light of the teachings of the prior art to a person of ordinary skill and creativity.

Clearly, such an apparatus would be useful and desirable.

2. Description of Prior Art

Musical instrument straps and ukulele straps are, in general, known.

While the structural arrangements of the above described devices may, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a musical instrument strap that does not require modification of the musical instrument.

It is also an important object of the invention to provide a musical instrument strap that does not require use of screws for attachment.

Another object of the invention is to provide a musical instrument strap that is secure and able to hold the musical instrument steadily.

Still another object of the invention is to provide a musical instrument strap that is easy to install or remove.

Still another object of the invention is to provide a musical instrument strap that is quick to install or remove.

Still yet another object of the invention is to provide a musical instrument strap that is inexpensive.

Yet another important object of the invention is to provide a musical instrument strap that will not cause any damage to the musical instrument.

Still yet another important object of the invention is to provide a musical instrument strap that is secured at a neck portion and a lower body portion of the musical instrument.

Yet another important object of the invention is to provide a musical instrument strap that does not require any modification to the musical instrument.

Briefly, a musical instrument strap that is constructed in accordance with the principles of the present invention has a holding strap that is placed over the neck of a user. A first end of the holding strap is attached to a magnetic assembly that includes one or more magnets. An opposite second end of the holding strap is secured around a neck of the musical instrument by any preferred arrangement, several of which are described in detail. The magnetic assembly includes one or more magnets inside of a fabric covering. One or more washers or a steel plate are disposed in an additional fabric covering that is placed through a sound hole of the musical instrument and into an interior of a base of the instrument. The magnetic assembly is placed, where desired, adjacent to an exterior surface of a planar member of the base. The planar member is typically a rear surface (or rear panel) of the base. The magnets attract and urge the washers or steel plate inside the instrument base into physical alignment with the magnets that are disposed on an exterior surface of the planar member of the base. This results in the magnetic assembly and the washers or steel plate being disposed on opposite surfaces of the planar member, thereby pinching the planar member between the magnetic assembly and the washers or steel plate. Friction secures the magnetic assembly and the washers or steel plate in position on the planar member of the base. The fabric covering can be modified to include any desired flexible material, including a material that helps to increase friction between the flexible material and the planar member while still helping to protect the planar member from scratches or other damage. An alternate embodiment simply reverses the positioning of the magnetic assembly and the washers or steel plate. For the alternate embodiment, the first end of the holding strap is, instead, attached to the steel plate and the magnetic assembly (in the fabric covering) is, instead, placed inside the interior of the base of the instrument. For the alternate embodiment the steel plate (also in the fabric covering) is placed where desired on the exterior surface of the planar member and is momentarily held in a desired position to attract the magnetic assembly into position. To remove the musical instrument strap from the instrument the magnetic assembly and the washers or steel plate are urged apart. This allows easy removal of the magnetic assembly or the washers/steel plate from the interior of the instrument. Attachment of the musical instrument strap to the neck of the instrument is removed. Accordingly, a low cost strap that is easy to install or remove, does not affect sound quality, does not require modification of the instrument, and does not damage the instrument is provided.

DETAILED DESCRIPTION OF THE INVENTION

Figure 1:
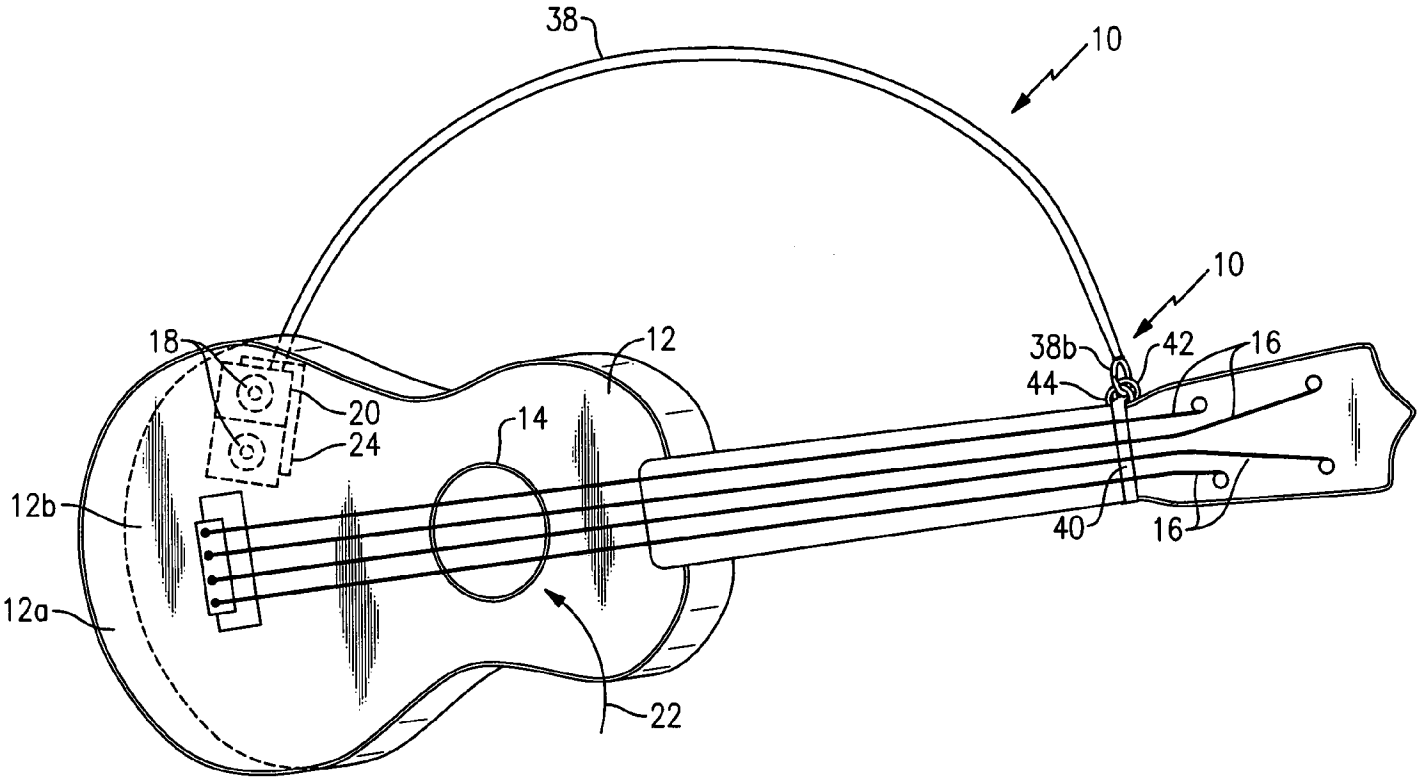
FIG. 1 is a view in perspective of a musical instrument strap showing a hidden pair of washers contained within a first fabric covering disposed in an interior of a ukulele, adjacent to a rear surface of the ukulele.

Referring on occasion to all of the FIGURE drawings and now, in particular to FIG. 1, is shown a musical instrument strap, identified in general, by the reference numeral 10 attached to a ukulele 12.

The reader will notice that reference is occasionally made throughout the DETAILED DESCRIPTION OF THE INVENTION suggesting that the reader refer to a particular drawing FIGURE. The suggestion is at times made when the introduction of a new element requires the reader to refer to a different drawing FIGURE than the one currently being viewed and also when the timely viewing of another drawing FIGURE is believed to significantly improve ease of reading or enhance understanding. To promote rapid understanding of the instant invention the reader is encouraged to periodically refer to and review each of the drawing FIGURES for possible cross-referencing of component parts and for other potentially useful information.

Certain examples are shown in the above-identified FIGURES and are described in greater detail below. In describing these examples, like or identical reference numerals may be used to identify common or similar elements.

The musical instrument strap 10 is preferably used to provide a means for holding the ukulele 12 while the ukulele 12 is being played or, alternately, when not in use. Other instruments that may be used with the musical instrument strap 10 include a guitar, a mandolin, or other instrument (not shown) that includes a sound hole 14.

The sound hole 14 is an opening provided on a front surface 12*a* of the ukulele 12 (or other instrument mentioned hereinabove) that helps project the sound created by vibrations of a set of four strings 16 of the ukulele 12 during play. Other instruments may include a different number of strings 16.

There are numerous equally effective embodiment variations possible for the musical instrument strap 10. One embodiment for the musical instrument strap 10 includes a pair of metal washers 18, shown in dashed lines in FIG. 1, that are disposed within a first fabric covering 20. Because the invention relies on magnetic attraction, the washers 18 are made of steel and therefore include iron.

Once understood, it becomes obvious that other embodiments can substitute other metallic forms for the washers 18 that are made of steel. The washers 18 are disclosed because they provide a readily available, low cost solution. If desired, a single planar piece of metal of any preferred size or shape, or a plurality of pieces of metal, or any preferred size or quantity of the metal washers 18 may be used.

To prevent scratching or damage to the ukulele 12, the metal washers 18 are placed within an interior of the first fabric covering 20 through an opening provided on the fabric covering 20. Once the metal washers 18 have been placed inside the first fabric covering 20, the opening is sewn shut or closed by any other preferred means to retain the washers 18 therein, in a side-by-side planar orientation.

The first fabric covering 20 may be made from any desired fabric or other thin flexible material. The first fabric covering 20 can be modified to include any desired flexible material, including a material that helps to increase friction between the flexible material and a rear surface 12*b* of the ukulele 12. This is described in greater detail, hereinafter.

The first fabric covering 20 helps protect an interior of the ukulele 12 from sustaining any damage while the metal washers 18 are within the interior 12*d* of the ukulele 12. The first fabric covering 20 is additionally useful in helping to keep the metal washers 18 together in a side-by-side orientation should more than one washer 18 be included. Furthermore, the first fabric covering 20 helps to provide easy retrieval of the metal washers 18 from the interior 12*d* of the ukulele 12. The metal washers 18 may, instead, include a steel plate that is planar and made of a ferric material for magnetic attraction.

The first fabric covering 20 containing the metal washers 18 (or steel plate) is placed within the interior 12*d* of the ukulele 12 through the sound hole 14, as shown by arrow 22. The ukulele 12 is then oriented to guide the first fabric covering 20 containing the metal washers 18 against the rear surface 12*b* of the ukulele 12 and near a bottom of the ukulele 12.

Figure 2:
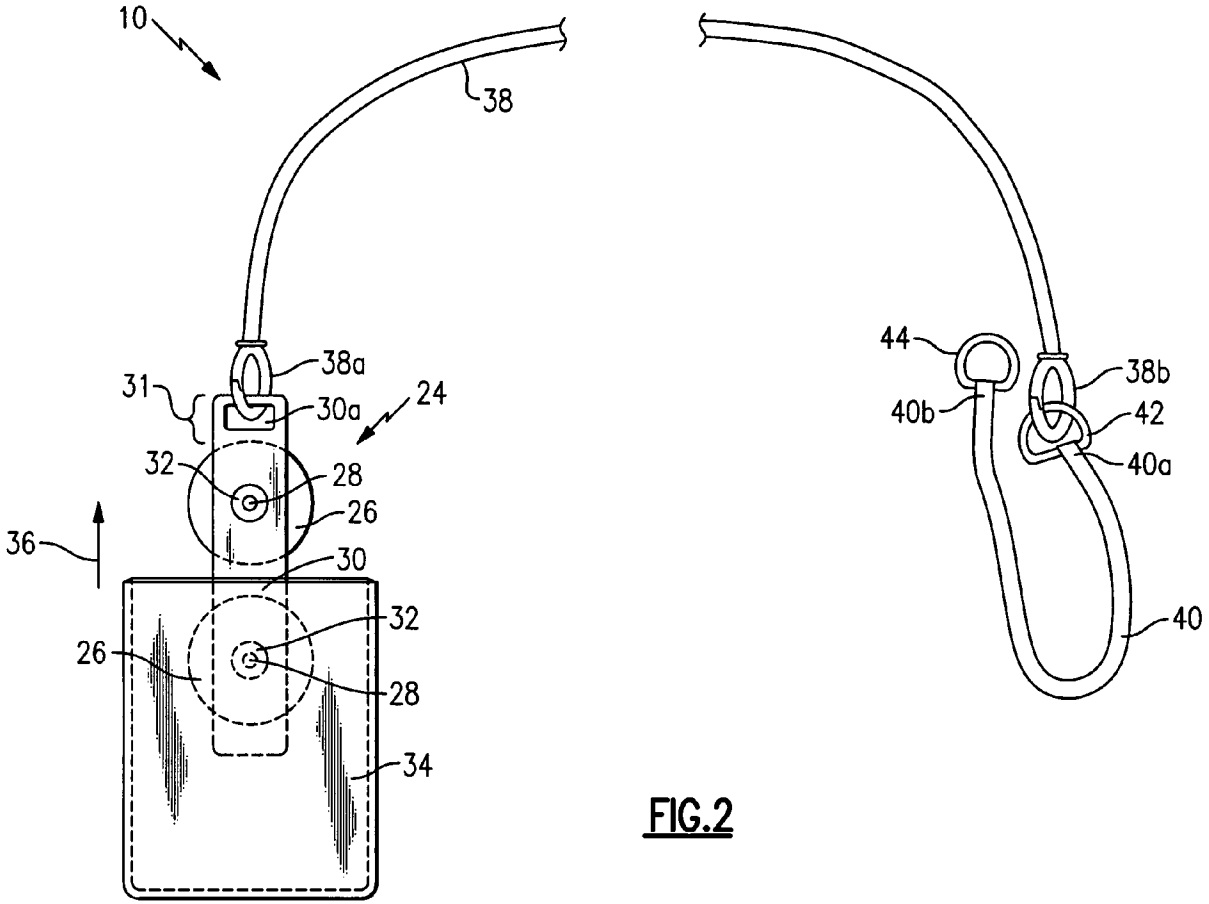
FIG. 2 is a view in perspective of a magnetic assembly partially disposed in a second fabric covering attached to a first end of musical instrument strap and a loop for placement around a neck of the ukulele attached to a second end of the musical instrument strap.

Now referring to FIG. 2, a magnetic assembly, identified in general by reference numeral 24 is shown in a partially completed form. The magnetic assembly 24 includes an adjacent pair of magnets 26. Two magnets 26 are preferred; however a single magnet or any other desired number of magnets may be utilized, as desired.

Each magnet 26 includes a threaded rod 28 that extends upward from a center of each magnet 26. The threaded rod 28 passes through a connecting plate 30 that holds the magnetic assembly 24 together and keeps the magnets 26 from being urged toward one-another by magnetic attraction. The connecting plate 30 is preferably made from plastic to help keep the magnetic assembly 24 lightweight. A nut 32 is fastened onto each threaded rod 28 to secure the connecting plate 30 to each of the magnets 26.

A second fabric covering 34 is placed over the magnetic assembly 24, as shown by arrow 36. The second fabric covering 34 is similar to a pouch (and to the first fabric covering 20) and is used to prevent damage from occurring to an exterior of the rear surface 12*b* of the ukulele 12. The second fabric covering 34 can be modified to include any desired flexible material, including a material that helps to increase friction between the flexible material and the rear surface 12*b* of the ukulele 12.

The second fabric covering 34 is partially sewn closed or any desired type of closure may be used. A section of the second fabric covering 34 remains open to permit an end portion, as shown by bracket 31, of the connecting plate 30 to protrude outward or to otherwise be accessible from an exterior of the second fabric covering 34. This is described in greater detail, below.

A length of strap 38 is provided that preferably includes a first clip 38*a* attached to a first end of the strap 38 and a second clip 38*b* attached to an opposite second end of the strap 38. The strap 38 includes any preferred type or length of flexible material. The strap 38 may vary depending on the type of the musical instrument. As the ukulele 12 is not very heavy, the strap 38 can be as light as a shoelace, if desired. The strap 38 may include a fixed length or it may include an adjustable length, as preferred.

The first clip 38*a* is secured onto a hole 30*a* that is provided in the end portion 31 of the connecting plate 30 of the magnetic assembly 24. The hole 30*a* is accessible through the partial opening provided in the second fabric covering 34.

Figure 3:
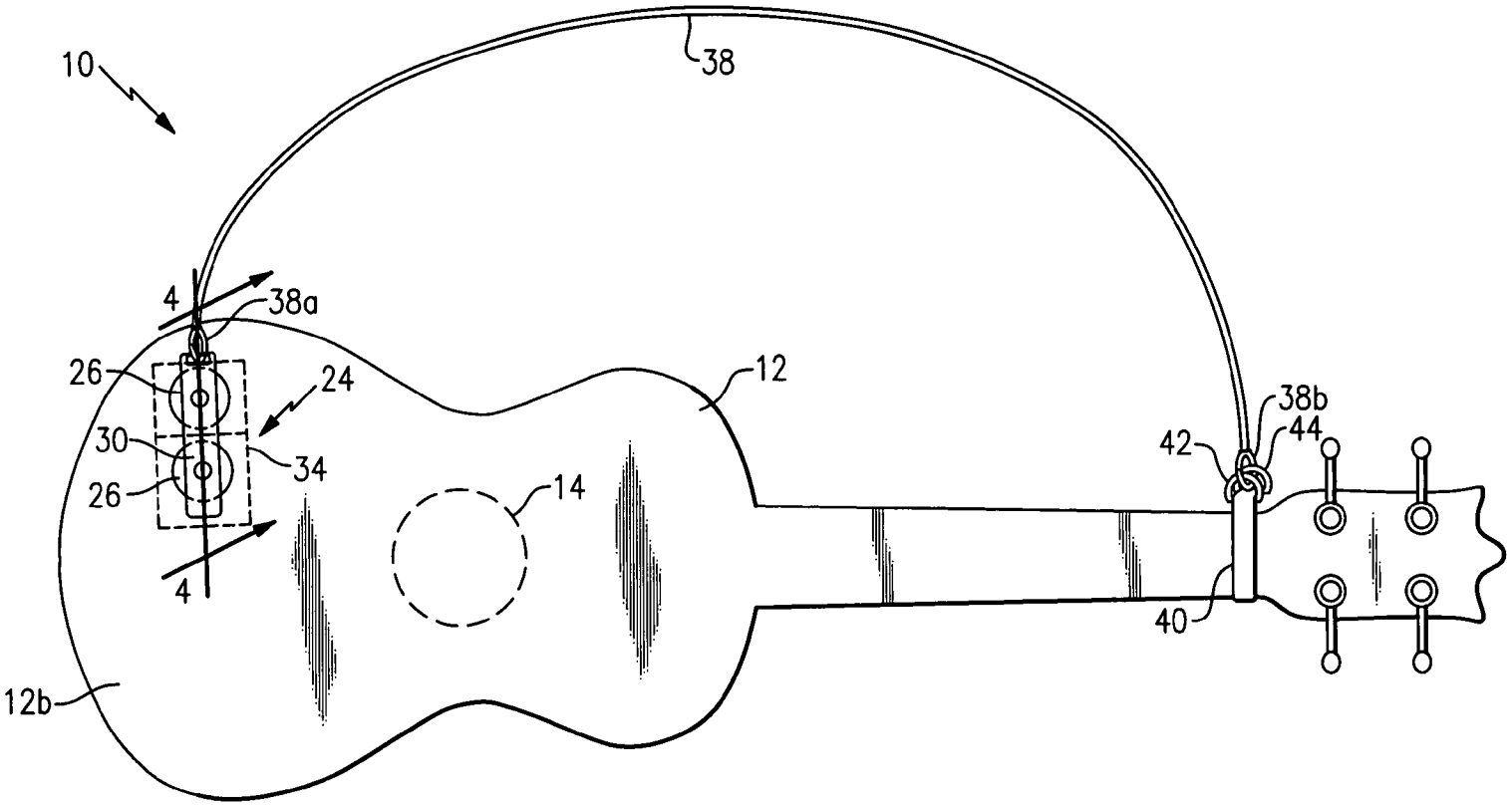
FIG. 3 is a rear view of the ukulele of FIG. 1 with the first end of the musical instrument strap attached to the rear surface of the ukulele and a modified Velcro strap attached around the neck of the ukulele.

A flexible loop 40 is provided that is placed around a neck portion of the ukulele 12, as shown in FIGS. 1 and 3. The flexible loop 40 can similarly be made from any desired material. One possible type of the flexible loop 40 is shown in FIG. 2.

As shown, the flexible loop 40 includes a first D-ring 42 attached to a first end of the flexible loop 40 and a second D-ring 44 attached to an opposite second end of the flexible loop 40.

The flexible loop 40 is urged under the strings 16 and around the neck of the ukulele 12. The second clip 38*b* is secured around the first D-ring 42 and around the second D-ring 44. Other types of rings may be used instead of D-rings 42, 44.

If preferred, the flexible loop 40 could be modified to include a strip of VELCRO™ that when wrapped around the neck and under the strings 16 would secure itself in position around the neck. In this instance the second clip 38*b* could simply loop around a portion of the modified flexible loop 40 (i.e., around the VELCRO™). Other variations to the flexible loop 40 are equally possible.

Figure 4:
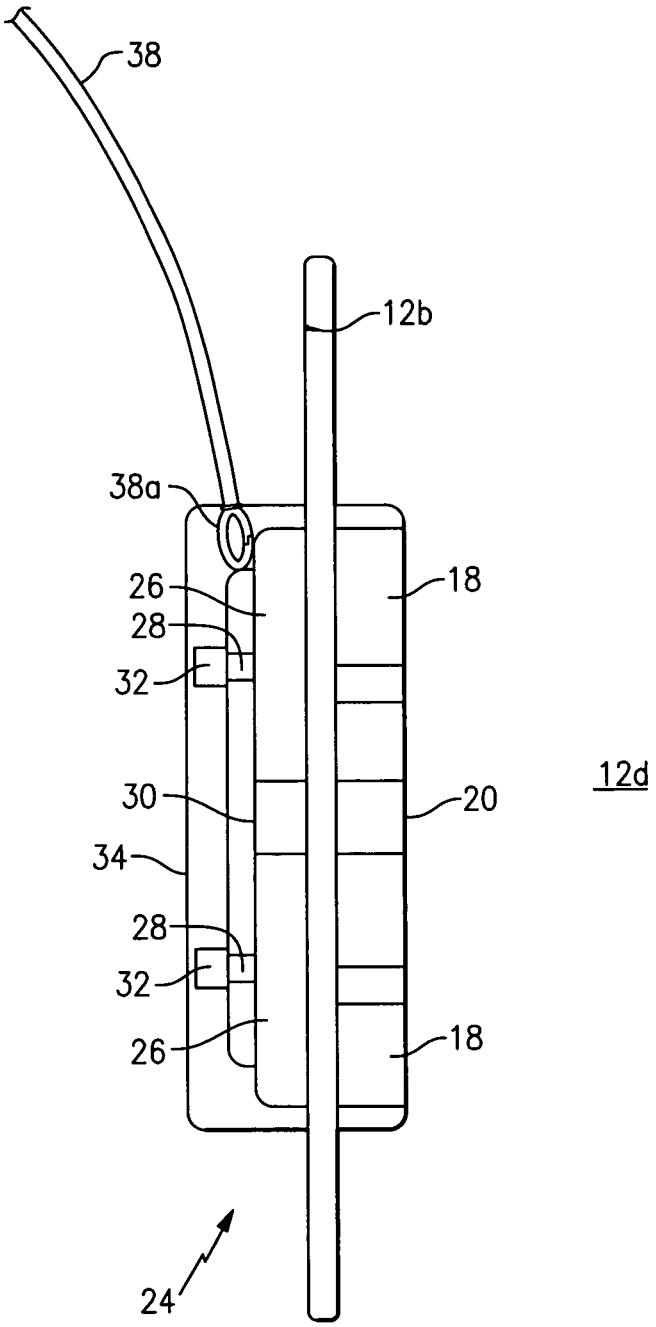
FIG. 4 is a cross-section view taken along the line 4-4 of FIG. 3.

Now referring to FIGS. 1, 3 and 4, to use the musical instrument strap 10, the flexible loop 40 is placed around the neck and the second clip 38*b* is secured around the b-rings 42, 44. The first clip 38*a* is attached to the hole 30*a* that is provided in the end portion 31 of the connecting plate 30 of the magnetic assembly 24.

The pair of metal washers 18 disposed within the first fabric covering 20 are placed into the interior 12*d* of the ukulele 12 body through the sound hole 14, as shown by arrow 22. The magnetic assembly 24 is placed onto an exterior of the rear surface 12*b* of the ukulele 12 generally where it is desired to stay during use. If desired, the magnetic assembly 24 may alternately be placed where desired onto the front surface 12*a* of the ukulele 12.

The magnets 26 of the magnetic assembly 24 provide a magnetic force that penetrates through the material of the ukulele 12 body and attracts the pair of metal washers 18 disposed within the interior 12*d* of the ukulele 12. This causes the washers 18 to shift position and align under the magnetic assembly 24, as shown in FIG. 4.

The magnetic attraction between metal washers 18 and the magnets 26 secures both the magnets 26 and the washers 18 in alignment with one-another on opposite sides of the rear surface 12*b* of the ukulele 12. The force of attraction is sufficient to retain the magnetic assembly 24, and the first end of the strap 38, in position. The strap 38 is placed around a neck of person (not shown) to provide a hands-free holding of the ukulele 12.

If a greater holding force is desired (for heavier types of musical instruments) then stronger or a greater quantity of the magnets 26 (not shown) are used as is a similar change to the washers 18 (or steel plate 102).

A significant benefit is realized in that the musical instrument strap 10 can be attached or removed in seconds. To remove it, a sufficient force is applied to the magnetic assembly 24 sufficient to urge the magnetic assembly 24 away from the rear surface 12*b* of the ukulele 12. This allows free movement of the washers 18 in the first fabric covering 20 inside the body of the ukulele 12. By then turning the ukulele upside down and tilting it, as needed, the first fabric covering 20 and the washers 18 (or metal plate) contained in the first fabric covering 20 are directed toward the sound hole 14 for easy removal.

Additionally, the first and second fabric coverings 20, 34 prevent scratching or damage to any portion of the ukulele 12.

Accordingly, the musical instrument strap 10 provides a solution for attaching a supporting type of strap to certain types of musical instruments with benefits and advantages not previously available. In particular, the musical instrument strap 10 is quick to install or remove, adjustable to the size and weight of the musical instrument, does not require any modification to the musical instrument, does not damage the musical instrument, securely retains the musical instrument, and does not affect the quality of sound produced by the musical instrument.

Figure 5:
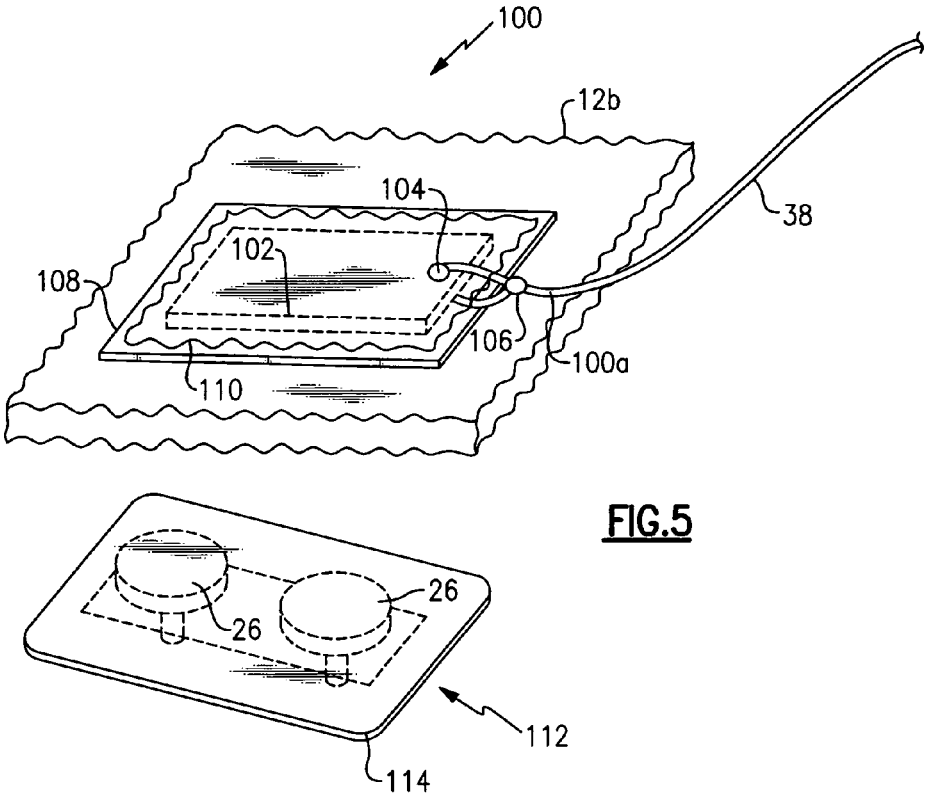
FIG. 5 is an exploded perspective view of a modified musical instrument strap.

Now referring to FIG. 5, a first end 100*a* of a modified musical instrument strap, identified in general by the reference numeral 100, is shown in exploded perspective view.

The modified musical instrument strap 100 includes any desired length of the strap 38 (only a portion, thereof, is shown). A steel metal plate 102 (dashed lines) includes a hole 104 at one-end, thereof. A first end of the strap 38 passes through the hole 104 and is secured to itself by a knot 106. One or more washers (not shown) could be used instead of the steel metal plate 102, if desired.

A modified fabric covering 108 surrounds the steel metal plate 102. A small opening is provided in the modified fabric covering 108 to permit the first end of the strap 38 to exit. Stitching 110 secures two opposite halves of the modified fabric covering 108 together around the steel metal plate 102.

A modified magnetic assembly, identified in general by the reference numeral 112, is provided that is substantially the same as the magnetic assembly 24 except the modified magnetic assembly 112 is not attached to the strap 38. A further modified fabric covering 114 surrounds the magnets 26 and completes the modified magnetic assembly 112.

During use of the modified musical instrument strap 100, the modified magnetic assembly 112 is placed through the sound hole 14 and adjacent on an interior of the rear surface 12*b*. The steel metal plate 102 with the modified fabric covering 108 surrounding the steel metal plate 102 and the first end of the strap 38 attached to the steel metal plate 102 is placed adjacent to an exterior of the rear surface 12*b*, where desired. The steel metal plate 102 is held for a short period of time in the desired position.

The force exerted by the magnets 26 upon the steel metal plate 102 urges the modified magnetic assembly 112 sufficient to move the modified magnetic assembly 112 and align the modified magnetic assembly 112 under the steel metal plate 102. At this time the steel metal plate 102 is released and the modified magnetic assembly 112 and the steel metal plate 102 are secured in position, where desired, each adjacent to one-another and to opposite sides of the rear surface 12*b*.

The opposite second end of the modified musical instrument strap 100 is attached to the neck of the ukulele 12 (or other musical instrument) as previously described or by any other preferred means.

Figure 6:
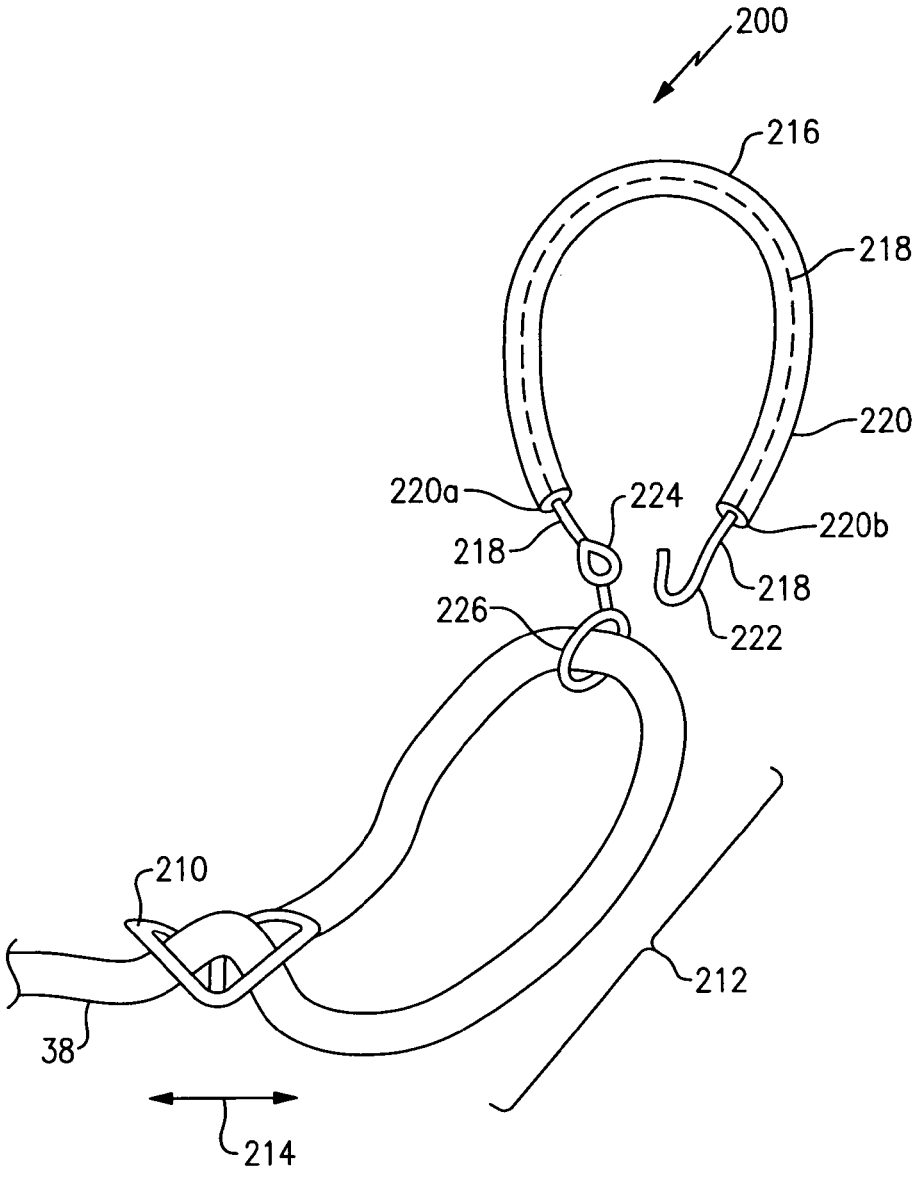
FIG. 6 is a perspective view of a modified second end of a musical instrument strap.

For example, referring now to FIG. 6 is shown a perspective view of a modified second end of a musical instrument strap, identified in general by the reference numeral 200.

The modified second end of a musical instrument strap 200 is used to illustrate two concepts, the first being that the overall length of the strap 38 can be adjustable and second, that many ways are possible for securing the second end to the neck of the ukulele 12 (or other musical instrument).

A distal end of the strap 38 is attached to a slideable buckle 210. The strap 38 passes through the slideable buckle 210 to form a strap loop, identified by bracket 212. By urging the slideable buckle 210 with respect to the longitudinal length of the strap 38 in either direction, as shown by arrow 214, the length of the strap 38 is set to whatever overall length is preferred. The slideable buckle 210 includes enough friction to retain its position along the longitudinal length of the strap 38 unless it is manually urged in either direction, as shown by arrow 214.

A simple, inexpensive modified loop 216 includes a flexible wire core 218 surrounded by a length of flexible tubing 220. The flexible tubing 220 prevents scratching of the neck of the ukulele 12. The wire core 218 exits the tubing 220 at a first end 220*a* of the tubing 220 and at an opposite end at a second end 220*b* of the tubing 220.

The wire core 218 terminates in a simple wire hook 222 at the second end 220*b* of the tubing 220. The wire core 218 forms a first wire loop 224 after it exits the first end 220*a* of the tubing 220. The wire core 218 extends beyond the first wire loop 224 and passes around the holding strap 38 to form a second wire loop 226 that is disposed along a longitudinal length of the strap loop 212.

In use, the wire hook 222 is urged under the strings 16 and around the neck of the ukulele 12 sufficiently far to permit attaching the wire hook 22 to the first wire loop 224. The tubing 220 prevents damage from occurring to the neck of the ukulele 12.

As the slideable buckle 210 is moved in either direction, as shown by arrow 214, the overall size of the strap loop 212 varies. The second wire loop 226 is able to pass along the length of the strap loop 212 until it comes to rest at, or near, a midpoint of the strap loop 212 during use.

The wire core 218, the tubing 220, the first wire loop 224, the second wire loop 226 and the wire hook 222 provide a modified neck assembly for attachment to the neck of the ukulele 12.

The modified neck assembly provides a low-cost way of attaching any version of the musical instrument strap 10, 100 to the neck of the ukulele 12 that is simple to use, easy to install or remove, and which will not cause damage to the neck of the ukulele 12.

The strap 38 of any version of the musical instrument strap 10, 100 is placed around the neck of the person to provide a hands-free holding of the ukulele 12 (or other musical instrument) while the ukulele 12 is played or during periods of inactivity. If the overall length of the strap 38 is adjustable, it is adjusted to a preferred length at the beginning of usage.

If desired, the second end of the holding strap 38 could include a simple termination (not shown). The second end of the strap 38 could be urged under the strings 16 and around the neck and tied to itself with a simple "bow" knot, similar to a type of knot that is commonly used to tie shoelaces together. This approach provides an especially low cost version of the musical instrument strap 10, 100.

As described herein, attachment of the first end of the strap 38 to the magnetic assembly 24 and placement of the washers 18 or the steel metal plate 102 (or steel member) against the interior 12*d* surface of the ukulele 12 (musical instrument) and placement of the magnetic assembly 24 on an adjacent exterior surface provides means for magnetically securing the first end of the strap 38 to a first location of the ukulele 12 or musical instrument.

As described herein, attachment of the first end of the strap 38 to the washers 18 or steel metal plate 102 and placement of the magnetic assembly 24 against the interior 12*d* surface of the ukulele 12 (musical instrument) and placement of the washers 18 or steel member on an adjacent exterior surface provides additional means for magnetically securing the first end of the strap 38 to a first location of the ukulele 12 or musical instrument.

Also, if desired for either of the above, the washers 18 or steel metal plate 102 can be replaced with a second magnetic assembly (not shown). The polarity of the magnets of the second magnetic assembly would be configured to cooperate with the (first) magnetic assembly 24. This would result in an increase in magnetic strength (i.e., magnetic flux) and a corresponding increase in the holding force, thereby providing further additional means for magnetically securing the first end of the strap 38 to a first location of the ukulele 12 or musical instrument.

The various described ways of securing the second end of the strap 38 to the neck of the ukulele 12 provide various means for securing the second end of the strap 38 to a second location of the ukulele 12 or musical instrument wherein the second location is different than the first location.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A musical instrument strap for use with a musical instrument that includes a sound hole, comprising:

(a) a flexible strap having a first end and an opposite second end;

(b) means for magnetically securing said first end of said strap to a first location of the musical instrument;

(c) means for securing said second end of said strap material to a second location of the musical instrument wherein said second location is different than said first location; and (d) wherein said means for magnetically securing includes a magnetic assembly, and wherein said magnetic assembly includes one or more magnets attached to said magnetic assembly, and wherein during use said magnetic assembly is urged through the sound hole into an interior of the musical instrument, and wherein said means for magnetically securing includes a member that is formed of steel or of another material that is capable of experiencing magnetic attraction, and wherein said first end of said strap is attached to said member and wherein, during use, said member is placed adjacent to an exterior surface of the musical instrument, whereby said magnetic assembly is urged toward said member by a magnetic force generated by said magnetic assembly until said magnetic assembly aligns with said member, whereby said magnetic assembly is disposed adjacent to an interior surface of the musical instrument on an inside of the musical instrument and said member is disposed adjacent to said exterior surface of the musical instrument, wherein an attraction between said magnetic assembly and said member is sufficient to retain said member in position adjacent to said magnetic assembly during use.

2. The musical instrument strap of claim 1 wherein said another material includes a second magnet.

3. The musical instrument strap of claim 1 wherein said magnetic assembly includes a covering.

4. The musical instrument strap of claim 3 wherein said covering protects the musical instrument.

5. The musical instrument strap of claim 3 wherein said covering increases friction.

6. The musical instrument strap of claim 1 wherein said member includes a covering.

7. The musical instrument strap of claim 6 wherein said covering protects the musical instrument.

8. The musical instrument strap of claim 6 wherein said covering increases friction.

9. The musical instrument strap of claim 1 wherein said means for securing said second end includes means for securing said second end to a neck of the musical instrument.

10. The musical instrument strap of claim 1 including means for adjusting an overall length of said strap.

11. A musical instrument strap for use with a musical instrument that includes a sound hole, comprising:

(a) a flexible strap having a first end and an opposite second end;

(b) means for magnetically securing said first end of said strap to a first location of the musical instrument;

(c) means for securing said second end of said strap material to a second location of the musical instrument wherein said second location is different than said first location; and (d) wherein said means for magnetically securing includes a member that is formed of steel or of another material that is capable of experiencing magnetic attraction, and wherein during use said member is urged through the sound hole into an interior of the musical instrument, and wherein said means for magnetically securing includes a magnetic assembly, and wherein said magnetic assembly includes one or more magnets attached to said magnetic assembly, and wherein said first end of said strap is attached to said magnetic assembly and wherein, during use, said magnetic assembly is placed adjacent to an exterior surface of the musical instrument, whereby said member is urged toward said magnetic assembly by a magnetic force generated by said magnetic assembly until said member aligns with said magnetic assembly, wherein said member is disposed adjacent to an interior surface of the musical instrument on an inside of the musical instrument and said magnetic assembly is disposed adjacent to said exterior surface of the musical instrument, wherein an attraction between said member and said magnetic assembly is sufficient to retain said magnetic assembly in position adjacent to said member during use.

12. The musical instrument strap of claim 11 wherein said another material includes a second magnet.

13. The musical instrument strap of claim 11 wherein said magnetic assembly includes a covering.

14. The musical instrument strap of claim 13 wherein said covering protects the musical instrument.

15. The musical instrument strap of claim 13 wherein said covering increases friction.

16. The musical instrument strap of claim 11 wherein said member includes a covering.

17. The musical instrument strap of claim 16 wherein said covering protects the musical instrument.

18. The musical instrument strap of claim 16 wherein said covering increases friction.

* * * * *